United States Patent [19]

Bodycomb

[11] 3,972,482

[45] Aug. 3, 1976

[54] ELECTRO-CHEMICAL CORROSION OF WORKING ELEMENTS

[75] Inventor: Alistair K. Bodycomb, Baie d'Urfe, Canada

[73] Assignee: Domtar Limited, Montreal, Canada

[22] Filed: May 13, 1975

[21] Appl. No.: 577,048

[30] Foreign Application Priority Data

May 18, 1974 United Kingdom ..... 22268/74

[52] U.S. Cl. ..... 241/30

[51] Int. Cl.[2] ..... B02C 7/11

[58] Field of Search ..... 241/30, 31, 250, 251, 241/259.1, 261.2, 261.3

[56] References Cited

UNITED STATES PATENTS 2,293,670 8/1942 Sickman ..... 241/31 X

*Primary Examiner*—Granville Y. Custer, Jr.

*Attorney, Agent, or Firm*—C. A. Rowley

[57] ABSTRACT

A method of reducing the corrosion of a pair of cooperating working elements that are mounted on a frame wherein one of said elements moves relative to the other in subjecting the material being treated to a working action which comprises electrically connecting said relatively moving element to the frame of the machine thereby to maintain said relatively moving element at substantially the same potential as the frame.

5 Claims, 5 Drawing Figures

×100

ELECTRO-CHEMICAL CORROSION OF WORKING ELEMENTS

FIELD OF THE INVENTION

The present invention relates to the electro chemical corrosion of cutters. More specifically the present invention relates to inhibiting electro chemical corrosion of elements such as pulp knives or refiner plates for high consistency refining working on moisture laden materials at elevated temperatures and abrasive conditions.

DESCRIPTION OF THE PRIOR ART

Prior to the present invention a knife for cutting wood pulp provided a substantially nit free product for approximately two days. When the present invention was applied to this same pulp knife system the knives consistently produced substantially nit free pulp for five days (nits are hard compressed modules of pulp that are not easily disintegrated into their individual fibres).

In the high-consistency refining of partially cooked wood chips or the like, for example, for formation of fibreboard for acoustic tile or corrugating medium and the like the refiner plate life was increased significantly when the present invention was applied.

SUMMARY OF THE PRESENT INVENTION

The present invention is based on the surprising discovery that if the shaft of the rotating pulp knife of the high consistency refiner equipment is connected to the equipment frame or casing that the rate of dulling of the knife or of the plate is substantially reduced.

A method of reducing the corrosion of a pair of cooperating working elements that are mounted on a frame wherein one of said elements moves relative to the other in subjecting the material being treated to a working action which comprises electrically connecting said relatively moving element to the frame of the machine thereby to maintain said relatively moving element at substantially the same potential as the frame.

It is believed that these reductions in dulling rates are due to inhibiting or corrosion of the surface of the plate or knife but it is not apparant why simply connecting the shaft electrically with the casing so that the casing and rotating element are at substantially the same potential would result in such marked improvements in knife or plate life.

BRIEF DESCRIPTION OF DRAWINGS

The invention will better be understood by reference to the accompanying drawings which illustrate preferred embodiments to the present invention.

DESCRIPTION OF PREFERRED EMBODIMENT

Figure 1:
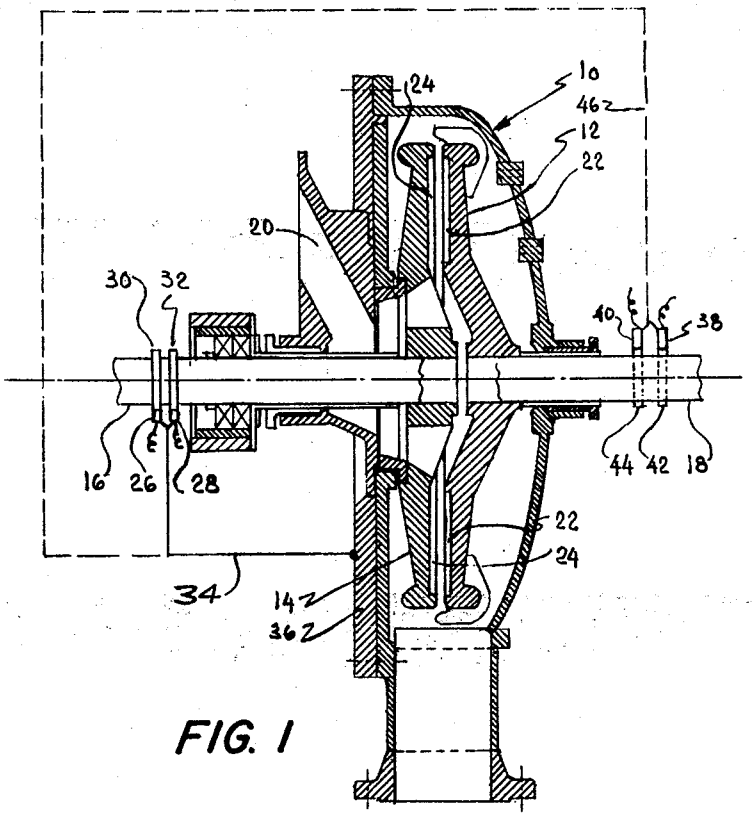
FIG. 1 is a schematic view illustrating the grounding of a double disc refiner.

Referring to FIG. 1 a double disc refiner is illustrated at 10. This refiner has a first disc 12 and a second disc 14 mounted on shafts 16 and 18 respectively. The shaft 16 and 18 may be driven by any suitable power source in the same or opposite directions thereby to obtain relative movement between the opposed faces of the discs. The material to be refined is introduced to the refiner via the inlet 20.

It will be noted that each of the discs 12 and 14 is provided with plates 22 and 24 respectively which cooperate to work with the feed material, say shavings and sawdust, or chips, to individual fibres. The plates 22 and 24 are provided in sets that are bolted to the discs 12 and 14 and it is these plates 22 and 24 that are worn by the refining operation. Plate life is determined in part by the quality of the pulp it produces based on subjective judgement.

The present invention consisted of a pair of carbon brushes 26 and 28 that in the actual experiment bore directly against the shaft 16 but in the illustrated arrangement have been shown as contacting slip rings 30 and 32 respectively. These brushes 26 and 28 are connected via a line 34 to the housing 36 of the refiner.

With the experimental arrangement as above indicated in one trial the refiner plates lasted approximately 40 days and were worn to the point where the ridges forming the pattern on the plates were substantially eliminated and only then were they judged to produce substandard material and require replacement. Before the instant invention was applied the plates averaged about 20 days. With the present invention the plate cannot always be worn to this extent with up to 25% increase in plate life being more representative.

Figure 3:
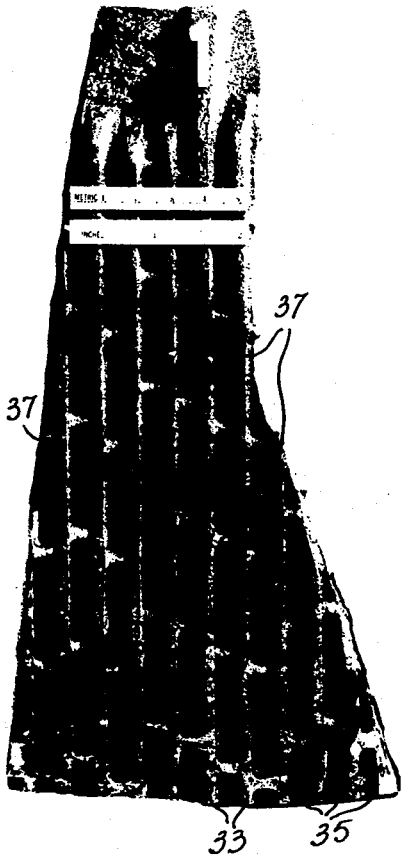
FIG. 3 is a reproduction from a photograph of a section of a worn refiner plate used without the present invention.
Figure 4:
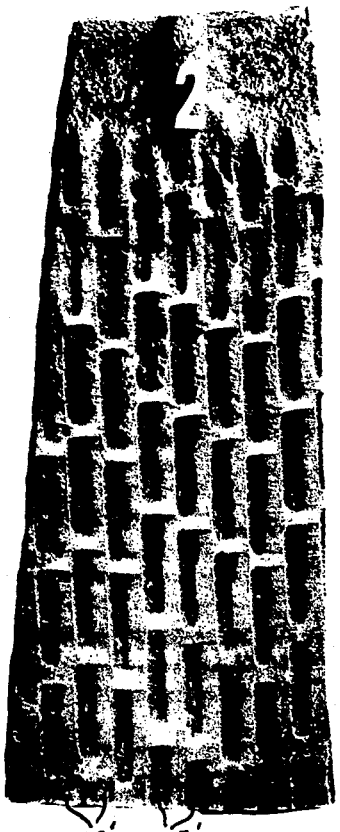
FIG. 4 is a reproduction of a photograph of a section of a worn refiner plate when the present invention is used.
Figure 5:
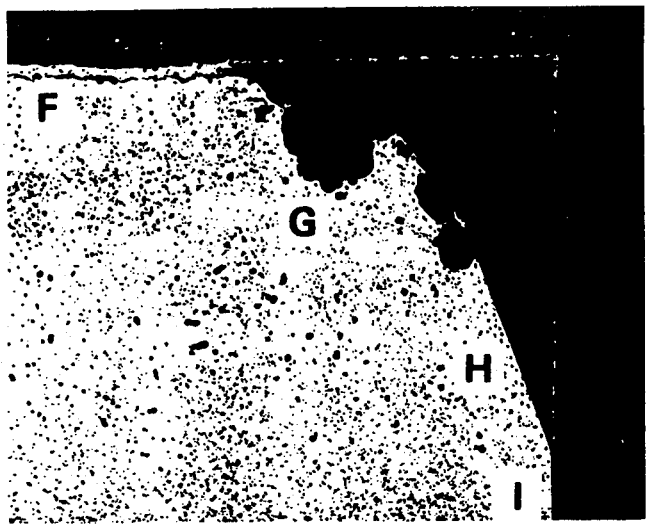
FIG. 5 is a reproduction from a photograph of a pulp bed knife magnified 100 times illustrating corrosion when the instant invention is not applied.

A comparison of FIGS. 3 and 4 clearly indicates that the used plate of FIG. 3 still retains a relatively deep pattern, i.e. ridges 33 (the lighter strips) and valleys 35 (the darker areas) are quite clear while the plate used with the present invention (FIG. 4) shows the ridges 33 to be almost completely worn away. As above indicated even with the present invention applied the plates are not always worn as illustrated by FIG. 5 but this figure and FIG. 3 provides a clearer indication of the differences between plates operated with and without the present invention. In the photograph of the plate in FIG. 3, the valleys are approximately one-quarter inch deep while in FIG. 4 adjacent the outer periphery (the lower portions of the drawings) the ridges have almost disappeared. Corroded areas 37 are clearly apparent in the photograph of FIG. 3 but are not nearly so apparent and do not appear to be in the same location in the FIG. 4 plate, thereby indicating that there is a different degree of corrosion with the instant invention and possibly something further due to the change in location of the corrosion.

In another mill refiners were ground by drilling a hole through the casing and inserting a rod through the hole to bear on the peripheral surface of the disc. The opposite end of the rod projected from the housing and was weighted to force the rod toward the disc and obtain the electrical contact. The rod was also electrically connected to the housing of the machine. The pulp treated in this mill was a neutral sulphite semi-chemical pulp. Two separate refiners were tested. Average hours for a set of plates before grounding was 611 hours on one refiner and 450 hours on the other. These averages increased respectively to 867 and 620 by application of the present invention. In this mill it was concluded that with proper maintenance of the electrical connections plate life could probably be increased on the average by 25%.

It is also contemplated to connect the shaft 18 to the housing 36 by means of brushes 38 and 40 which cooperate with slip rings 42 and 44 and are connected to the housing 36 by the line 46 which has been shown in dotted configuration since it did not exist on the experimental arrangement.

Figure 2:
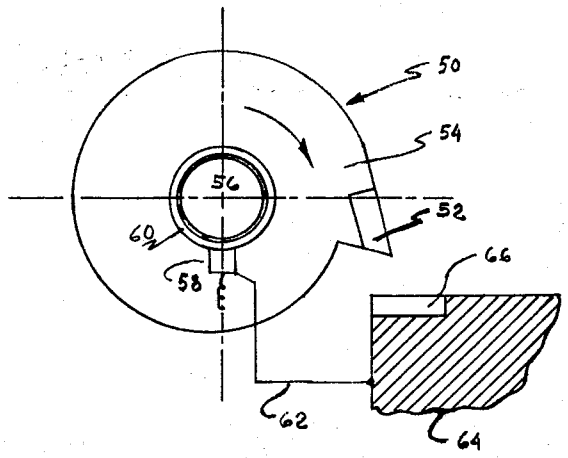
FIG. 2 is a schematic view of a grounding brush applied to the shaft of a cutter particularly for cutting pulp.

The original application of the present invention was to a pulp cutter indicated schematically at 50 in FIG. 2. This cutter includes a cutter knife 52 mounted on a cylinder 54 which is rotated via a shaft 56. A suitable carbon brush 58 contacts a slip ring 60 and connects the shaft and thus the cylinder and blade 52 via line 62 to the frame 64 on which are mounted the bed knife 66 and the bearings (not shown) for shaft 56. As a result of this connection the rate of dulling of the knife 52 was substantially reduced. As above indicated when connected as illustrated in FIG. 2, the pulp knife effectively cut pulp without producing significant quantities of nits for five days whereas prior to the installation of the line 62 the pulp knives averaged about 2 days of substantially nit free production.

FIG. 5 shows the corrosion that was found on the bed knife of the pulp cutter before the instant invention was applied. The knife was examined under a microscope at 100 magnifications when this corrosion was discovered.

As above indicated it is not clear why simply grounding of the pulp knife cutter and the shaft of the double disc should materially reduce corrosion or wear of the plates, however, the evidence clearly indicates this to be the case.

The following are specific examples of the electrical conditions before and after grounding of the pulp knife and refiner.

EXAMPLES

Tests were carried out on two Model No. 411 Bauer double disc refiners. The refiners had a diameter of 40 inches and an r.p.m. of 1200. Plates used were Canron Ltd. plates no. 30–314 NH and 40–315 NH formed from the alloy sold under the trade name "Ni Hard".

The only difference between these plates is the height of the teeth, (314 has 5/16 inch teeth and 315 has ¼ teeth). There are six plates per disc.

The refiner operated on a mixture of sawdust and shavings at a consistency of about 12%. Readings were taken periodically to measure the EMF to ground with and without the grounding brush of the present invention. The arrangement was essentially as shown in FIG. 1 with only one shaft connected to the frame, namely, the feed side shaft.

The following are the results obtained:

| REFINER NO. | TEST NO. | LOADED | GROUNDED | EMF TO GROUND FEED SIDE (M.V.) D.C. | EMF TO GROUND CONTROL SIDE (M.V.) D.C. |
|---|---|---|---|---|---|
| 1 | 1 | No | No | −25 | −50 |
| | 2 | No | Yes | − 2 | − |
| | 3 | Yes | No | −125 | −125 |
| | 4 | Yes | Yes | − 1 | − 1 |
| | 5 | Yes | No | −20 | −40 |
| | 6 | Yes | Yes | − 5 | −35 |
| | 7 | Yes | Yes | − 1 | −25 |
| 2 | 8 | Yes | Yes | −80 | −95 |
| | 9 | Yes | No | −450 | −440 |
| | 10 | Yes | Yes | −130 | −160 |
| | 11 | 90–110 Amp. | Yes | −70 | −85 |
| | 12 | Yes | Yes | − 7 | − 2 |
| | 13 | 130 Amp. | Yes | −45 | −115 |
| | 14 | Yes | No | −70 | −100 |
| | 15 | Yes | Yes | −15 | −35 |

It will be apparent that the EMF to ground varies quite substantially. For example, in tests No. 1, 2, 3 and 4 which were carried out on refiner No. 1 it is apparent that with no load and no grounding, the EMF generated is relatively high as indicated by test No. 1 and when grounded the EMF substantially disappeared as indicated in test No. 2. Test No. 3 with the refiner loaded but not grounded the EMF was 125 whereas under the similar conditions with the ground brush applied the EMF was reduced on the both the control and feed sides to about one milli-volt. Test No. 1, 2, 3 and 4 were taken at the same time. Test No. 5 and 6 were taken at a later time and test No. 7 at a still later time.

Refiner No. 1 operated effectively for 42 working days before the plates had to be replaced.

Similar results were obtained with refiner No. 2, however, it will be noted that with refiner No. 2 the EMF generated was always substantially higher than with refiner No. 1. During the first 8 days of operation of refiner No. 2 the shaft was not electrically connected to the frame or casing. The plates on this refiner operated for 32 days.

It will also be apparent from the above that the electrical connections used in the above tests were not completely effective to dissipate the total EMF generated, however, in all cases there was a substantial reduction in the EMF when the shaft was electrically connected to the frame. Probably the problem in obtaining a proper connection was due to dirt accumulating under the brushes.

Modification may be made without departing from the spirit of the invention defined in the appended claims. For example the invention may also be applied to single disc refiner. The invention will not normally be applied to low consistency refiners as the wear and corrosion in this type of application is very low and the contribution of the present invention would not be significant.

I claim:

1. A method of reducing corrosion of working elements processing materials under condition wherein said elements are subject to corrosion and abrasion and wherein said elements are mounted on a frame and one of said elements is moved relative to the other, said method comprising electrically connecting said relatively moving element to said frame thereby to maintain said relatively moving element at substantially the same potential as said frame.

2. A method as defined in claim 1 wherein said relatively moving element is a rotary pulp cutter knife.

3. A method as defined in claim 1 wherein said relatively moving element comprises refiner plates mounted on a rotating refiner disc operating at high consistency.

4. A method of improving plate life of a high consistency disc refiner having at least one rotating disc comprising electrically connecting said rotating disc to the frame of said refiner to maintain said rotating disc and said frame at substantially the same potential.

5. A method as defined in claim 4 wherein both of said discs rotate and wherein both of said discs are electrically connected to said frame to maintain both of said discs at substantially the same electrical potential as said frame.

* * * * *